US009999252B2

(12) United States Patent
Liu

(10) Patent No.: US 9,999,252 B2
(45) Date of Patent: Jun. 19, 2018

(54) ATOMIZATION ASSEMBLY AND ELECTRONIC CIGARETTE

(71) Applicant: HUIZHOU KIMREE TECHNOLOGY CO., LTD., Huizhou, Guangdong (CN)

(72) Inventor: Qiuming Liu, Shenzhen (CN)

(73) Assignee: HUIZHOU KIMREE TECHNOLOGY CO., LTD., Huizhou, Guangdong (CN)

( * ) Notice: Subject to any disclaimer, the term of this patent is extended or adjusted under 35 U.S.C. 154(b) by 0 days. days.

(21) Appl. No.: 15/323,828

(22) PCT Filed: Aug. 14, 2014

(86) PCT No.: PCT/CN2014/084419

§ 371 (c)(1),
(2) Date: Jan. 4, 2017

(87) PCT Pub. No.: WO2016/023213

PCT Pub. Date: Feb. 18, 2016

(65) Prior Publication Data

US 2017/0143040 A1 May 25, 2017

(51) Int. Cl.
*A24F 47/00* (2006.01)
*H05B 3/42* (2006.01)

(52) U.S. Cl.
CPC ..... *A24F 47/008* (2013.01); *H05B 3/42* (2013.01); *H05B 2203/021* (2013.01)

(58) Field of Classification Search
CPC ..... A24F 47/008
(Continued)

(56) References Cited

U.S. PATENT DOCUMENTS

2014/0150785 A1* 6/2014 Malik ..... A61M 15/06 128/202.21
2015/0189919 A1* 7/2015 Liu ..... A24F 47/008 131/329

FOREIGN PATENT DOCUMENTS

CN 201525085 * 11/2012 ..... A24F 47/00
CN 202525085 U 11/2012
(Continued)

OTHER PUBLICATIONS

International Search Report (ISR) issued by the State Intellectual Property Office of the Peoples Republic of China on May 22, 2015 for PCT/CN2014/084419, China.

*Primary Examiner* — Phuong Dinh
(74) *Attorney, Agent, or Firm* — Tim Tingkang Xia, Esq.; Locke Lord LLP

(57) ABSTRACT

The present invention discloses an atomization assembly and an electronic cigarette. An atomization assembly comprises a transparent atomization sleeve. One end of the atomization sleeve is connected to a connection column, and the other end of the atomization sleeve is detachably connected to an atomization core configured to atomize smoke tar. A vent-pipe with two ends being inserted into the connection column and the atomization core respectively is sheathed in the atomization sleeve, and a first oil storage container for storing the smoke tar is formed between the atomization sleeve and the vent-pipe. The following advantageous effects can be achieved: the user can disassemble the suction nozzle cover at regular time to clean the liquid smoke stored in the oil storage container; besides, it is convenient to change the atomization core, to view the residual smoke tar and to add the smoke tar.

15 Claims, 11 Drawing Sheets

(58) Field of Classification Search
USPC ..... 131/173–330
See application file for complete search history.

(56) References Cited

FOREIGN PATENT DOCUMENTS

| | | | |
|---|---|---|---|
| CN | 103462224 | A | 12/2013 |
| CN | 203538388 | U | 4/2014 |
| CN | 203555161 | U | 4/2014 |
| CN | 203633513 | U | 6/2014 |
| CN | 203723439 | U | 7/2014 |
| CN | 204157646 | U | 2/2015 |
| WO | 2014110119 | A1 | 7/2014 |

* cited by examiner

ATOMIZATION ASSEMBLY AND ELECTRONIC CIGARETTE

TECHNICAL FIELD

The present application relates to the field of electronic cigarettes, and more particularly relates to an atomization assembly and an electronic cigarette.

BACKGROUND OF THE INVENTION

In the prior art, an electronic cigarette comprises an atomization assembly and a battery assembly. The atomization assembly comprises an atomization sleeve, and a suction nozzle fixedly connected to one end of the atomization sleeve. Since the suction nozzle is fixedly connected to the atomization sleeve, smoke tar condensed on the smoke channel cannot be cleaned. After using for a period of time, the user may suck the condensed smoke tar into their mouth, and thus affecting the experience of the user.

The atomization assembly further comprises an internal threaded structure and an external threaded structure connected to the other end of the atomization sleeve. After successively passing through an air inlet of the internal thread, an air inlet of the external thread, an air inlet of a top electrode, the airflow arrives at the atomizing channel, and finally enters into the mouth of the user. When assembling, the air inlet of the internal thread and the air inlet of the external thread are not easy to be aligned (the inlets are in different axes), and when the airflow flows, it is easy to generate noise.

In addition, an atomization device in the atomization assembly is in an undetectable structure. Since the atomization device is a vulnerable component, the user can only change the whole atomization assembly after the atomization device is damaged, and this increases the use cost and goes against the promotion of products.

SUMMARY OF THE INVENTION

The objective of the present invention is to provide an atomization assembly and an electronic cigarette, aiming at the above-mentioned drawbacks.

The technical solutions of the present invention for solving the technical problems are as follows:

An atomization assembly configured to combine with a battery assembly to form an electronic cigarette is provided, and the atomization assembly comprises a transparent atomization sleeve. One end of the atomization sleeve is connected to a connection column, and the other end of the atomization sleeve is detachably connected to an atomization core configured to atomize smoke tar. A vent-pipe with two ends being inserted into the connection column and the atomization core respectively is sheathed in the atomization sleeve, and a first oil storage container configured to store the smoke tar which will be atomized by the atomization core is formed between the atomization sleeve and the vent-pipe;

One end of the atomization core is flexibly and hermetically connected to the vent-pipe, and the other end of the atomization core, detachably connected to the battery assembly, extends outside the atomization sleeve. One end of the connection column, extending outside the atomization sleeve, is detachably connected to a suction nozzle cover, and a second oil storage container connected to the vent-pipe is sheathed in the suction nozzle cover. An outlet configured to discharge the airflow is defined in the side wall of the second oil storage container, so that when the smoke atomized by the atomization core flows to the outlet through the vent-pipe, condensed smoke tar is able to be stored in the second oil storage container.

In the atomization assembly of the present invention, both the suction nozzle cover and the connection column are made of metal.

In the atomization assembly of the present invention, a threaded connection structure or a buckle connection structure is arranged at a junction between the suction nozzle cover and the connection column.

In the atomization assembly of the present invention, an atomization chamber communicating with the vent-pipe and a heating wire assembly received in the atomization chamber are arranged in the atomization core, and a through-hole configured for air inflow and discharging the smoke tar in the atomization chamber is defined at one end of the atomization core and the end extends outside the atomization sleeve, and the through-hole communicates with the atomization chamber.

In the atomization assembly of the present invention, the atomization core comprises a connection sleeve detachably connected to the atomization sleeve, the heating wire assembly and an atomization cover, the atomization chamber is defined in the connection sleeve and axially passes through the connection sleeve, and the through-hole communicating with the atomization chamber is defined on a circumferential wall of the connection sleeve;

One end of the connection sleeve is detachably connected to the battery assembly, and two mounting notches corresponding to each other are defined at the other end of the connection sleeve; the two mounting notches are communicated with the first oil storage container and extend away from the suction nozzle cover, and the heating wire assembly is mounted in the two mounting notches;

The atomization cover is configured to sheathe the connection sleeve and the vent-pipe, and is abutted against the heating wire assembly; and one end of the vent-pipe passes through the atomization cover and extends inside the atomization chamber.

In the atomization assembly of the present invention, a limit protruding part abutted against an end surface of the atomization cover is arranged at an outer surface of the connection sleeve.

In the atomization assembly of the present invention, a protruding part configured for supporting the heating wire assembly is arranged on an outer surface of the connection sleeve.

In the atomization assembly of the present invention, an oil absorbing element is received in the second oil storage container.

In the atomization assembly of the present invention, an annular protruding platform configured to block the smoke tar is arranged on the side wall of the second oil storage container, the annular protruding platform is located around a circumferential of the outlet and extends toward the atomization sleeve.

In the atomization assembly of the present invention, the connection column comprises a first connection portion configured for plugging with the atomization sleeve, and a second connection portion configured for detachably connecting to the suction nozzle cover;

An annular slot is defined on the outer circumferential wall of the first connection portion, and a first sealing element flexibly abutted against an inner wall of the atomization sleeve is fixed in the annular slot.

In the atomization assembly of the present invention, a fixing recess is axially arranged at one end of the connection column and the end is away from the suction nozzle cover, and one end of the vent-pipe is abutted against and is fixed in the fixing recess; an air groove communicating with the fixing recess is arranged at the other end of the connection column and the other end is close to the suction nozzle cover.

In the atomization assembly of the present invention, a connecting element detachably connected to the atomization core is connected to one end of the atomization sleeve via a plug connection and the end is away from the suction nozzle cover, and a threaded connection structure or a buckle connection structure is defined at a junction between the connecting element and the atomization core.

In the atomization assembly of the present invention, a second sealing element flexibly abutted against an inner wall of the atomization sleeve is arranged at an outer circumferential wall of the atomization core located in the atomization sleeve.

In the atomization assembly of the present invention, a third sealing element is arranged at a junction of the atomization core and the junction is configured for flexibly and hermetically connecting to the vent-pipe.

In the atomization assembly of the present invention, an outer end surface of the suction nozzle cover is spherical.

The present invention further provides an electronic cigarette, comprising an atomization assembly and a battery assembly connected to the atomization assembly, and the atomization assembly comprises a transparent atomization sleeve. One end of the atomization sleeve is connected to a connection column, and the other end of the atomization sleeve is detachably connected to an atomization core configured to atomize the smoke tar. A vent-pipe with two ends being inserted into the connection column and the atomization core respectively is sheathed in the atomization sleeve, and a first oil storage container configured to store the smoke tar which will be atomized by the atomization core is formed between the atomization sleeve and the vent-pipe;

One end of the atomization core is flexibly and hermetically connected to the vent-pipe, and the other end of the atomization core, detachably connected to the battery assembly, extends outside the atomization sleeve. One end of the connection column, extending outside the atomization sleeve, is detachably connected to a suction nozzle cover, and a second oil storage container connected to the vent-pipe is defined in the suction nozzle cover. An outlet configured to discharge the airflow is defined in the side wall of the second oil storage container, so that when the smoke atomized by the atomization core flows to the outlet through the vent-pipe, condensed smoke tar is able to be stored in the second oil storage container.

In summary, when implementing the atomization assembly and the electronic cigarette of the present invention, the following advantageous effects can be achieved: firstly, by arranging the second oil storage container in the suction nozzle cover, when smoking, the liquid smoke condensed on the vent-pipe flows into the second oil storage container in the suction nozzle cover along the airflow and is stored therein, and since the suction nozzle cover is detachably connected to the connection column, the user can disassemble the suction nozzle cover at regular time to clean the liquid smoke stored in the second oil storage container and to prevent the user from sucking in the liquid smoke; secondly, comparing with the prior suction nozzle cover directly and tightly connected to the atomization sleeve, the threaded connection structure or the buckle connection structure between the suction nozzle cover and the connection column makes it easier to disassemble the suction nozzle cover, and avoids the problem of easily to fall off, and since the suction nozzle cover and the connection column are made of metal, when hard objects such as the tooth in the mouth are gripped on the connection column, it can avoid the suction nozzle cover easily falling off because of the elastic deformation; lastly, the limit protruding part abutted against the end surface of the atomization cover is defined at the outer surface of the connection sleeve, so that it avoids the atomization cover excessively compressing the heating wire assembly, and the protruding part configured to support the heating wire assembly is defined at the outer surface of the connection sleeve, so that it avoids the heating wire assembly sliding into the atomization chamber due to the side wall for supporting the heating wire assembly being too thin. Moreover, it is convenient to change the atomization core to save the costs, and it is convenient to add the smoke tar. The transparent atomization sleeve makes the user easy to view the residual smoke tar, and it is convenient to add the smoke tar in time to avoid the heating wire assembly being burned.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENTS

To make the technical feature, objective and effect of the present invention be understood more clearly, now the specific implementation of the present invention is described in detail with reference to the accompanying drawings and embodiments. It should be understood that the specific embodiments described herein are only used to explain the present invention and are not intended to limit the present invention.

Figure 1:
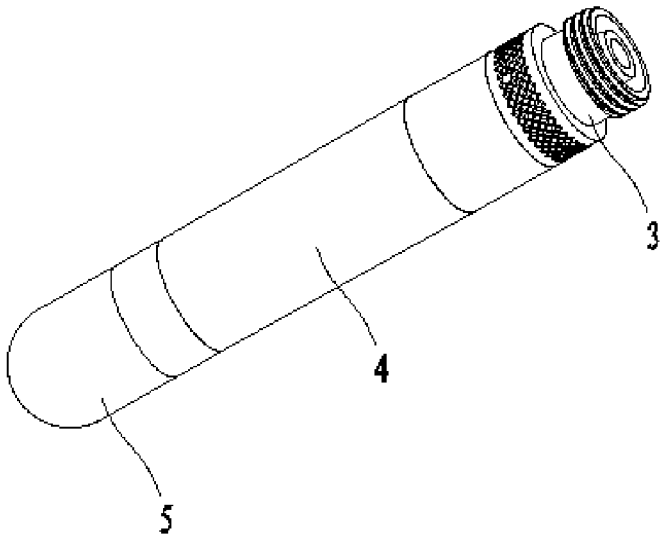
FIG. 1 is a space diagram of an atomization assembly, according to a preferred embodiment of the present invention.
Figure 2:
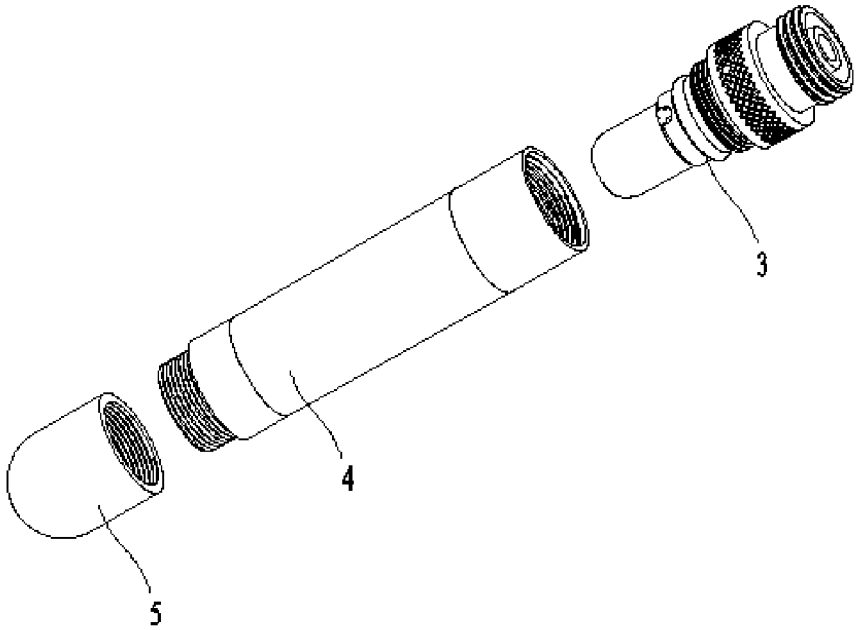
FIG. 2 is an exploded view of the atomization assembly of FIG. 1.

FIGS. 1 and 2 show an atomization assembly, according to a preferred embodiment of the present invention. The atomization assembly is configured to combine with a battery assembly (not shown) to form an electronic cigarette. The atomization assembly comprises a body assembly 4, an atomization core 3 and a suction nozzle cover 5 detachably connected to the two ends of the body assembly 4 respectively.

Figure 3:
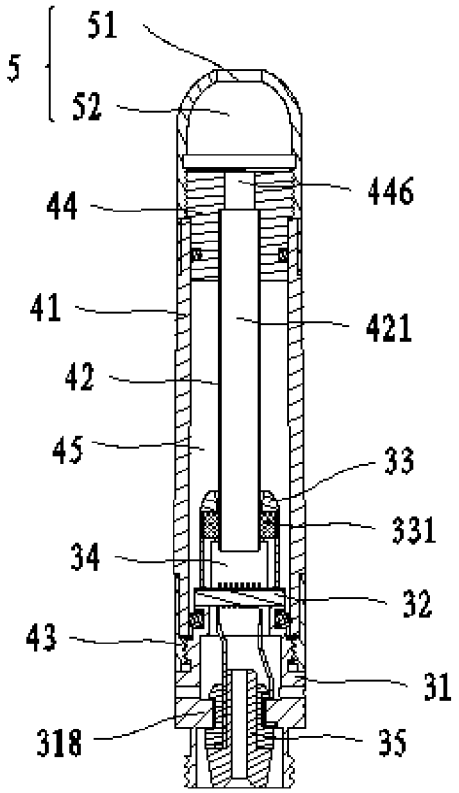
FIG. 3 is a structure schematic view of the atomization assembly of FIG. 1.

Specifically, as shown in FIG. 3, the body assembly 4 comprises a transparent atomization sleeve 41. One end of the atomization sleeve 41 is connected to a connection column 44, and the other end of the atomization sleeve 41 is detachably connected to an atomization core 3 configured to atomize the smoke tar. A vent-pipe 42 with two ends being inserted into the connection column 44 and the atomization core 3 respectively is sheathed in the atomization sleeve 41, and a first oil storage container 45 configured to store the smoke tar which will be atomized by the atomization core 3 is formed between the atomization sleeve 41 and the vent-pipe 42.

One end of the atomization core 3 is flexibly and hermetically connected to the vent-pipe 42, and the other end of the atomization core 3, detachably connected to the battery assembly, extends outside the atomization sleeve 41. One end of the connection column 44, extending outside the atomization sleeve 41, is detachably connected to the suction nozzle cover 5, and a second oil storage container 52 communicating with the vent-pipe 42 is defined in the suction nozzle cover 5. An outlet 51 configured to discharge the airflow is defined in the side wall of the second oil storage container 52, so that when the smoke atomized by the atomization core 3 flows to the outlet 51 through the vent-pipe 42, condensed smoke tar is able to be stored in the second oil storage container 52.

In the embodiment, the second oil storage container 52 is defined in the suction nozzle cover 5, so when smoking, the liquid smoke condensed on the vent-pipe 42 flows into the second oil storage container 52 in the suction nozzle cover 5 along the airflow and is stored therein, and since the suction nozzle cover 5 is detachably connected to the body assembly 4, the user can disassemble the suction nozzle cover 5 at regular time to clean the liquid smoke stored in the second oil storage container 52 and to prevent the user from sucking in the liquid smoke.

As shown in FIG. 3, the outlet 51 is defined at a bottom wall of the second oil storage container 52, so it is convenient for the user to smoke. And since an outer end surface of the suction nozzle cover 5 is spherical, it makes the suction nozzle cover 5 more beautiful and easily to be cleaned.

The suction nozzle cover 5 is detachably connected to the connection column 44. In the embodiment, the suction nozzle cover 5 is connected to the connection column 44 through a threaded connection, namely an internal thread is arranged at a junction of the suction nozzle cover 5 connected to the connection column 44 and an external thread matching the internal thread is arranged at an outer surface of the connection column 44. If other detachable connection structure is employed, other connection structure can be arranged on the suction nozzle cover 5, for example, a flexible buckle shell fragment in a buckle connection etc. In the embodiment, the threaded connection is only described as an example and it is not limited to the threaded connection.

In the embodiment, comparing with the prior tight connection, the threaded connection structure or the buckle connection structure makes it easier to disassemble the suction nozzle cover 5, and avoids the problem of being easily fallen off in the prior tight connection.

Further, in the embodiment, since the suction nozzle cover 5 and the connection column 44 are made of metal, when hard objects such as the tooth in the mouth are gripped on the connection column 44, it can avoid the suction nozzle cover 5 easily falling off, wherein, the metal may be copper, iron or steel and other metals, and it is not limited here.

The specific structure of the body assembly 4 will be described in detail with the embodiments shown in FIGS. 3 to 5.

The body assembly 4 mainly comprises an atomization sleeve 41, a vent-pipe 42, a connecting element 43, a connection column 44 and a first oil storage container 45.

The structure of the atomization sleeve 41 is approximately cylindrical, and the connecting element 43 and the connection column 44 are connected to the two ends of the atomization sleeve 41 respectively. The vent-pipe 42 is sheathed in the atomization sleeve 41 axially. The first oil storage container 45 is formed between the atomization sleeve 41 and the vent-pipe 42. The smoke tar being atomized by the atomization core 3 is stored in the first oil storage container 45. In the embodiment, in order to make it convenient for the user to view the residual smoke tar in the first oil storage container 45, the atomization sleeve 41 is made of transparent material.

An airflow channel for enabling the airflow flow into the suction nozzle cover 5 is defined in the vent-pipe 42, and the two ends of the vent-pipe 2 are inserted into the connection column 44 and the atomization core 3 respectively.

One end of the atomization sleeve 41, configured to connect to the atomization core 3, is inserted into the connecting element 43. The connecting element 43 is detachably connected to the atomization core 3. In the embodiment, the connecting element 43 is connected to the atomization core 3 through a threaded connection. An internal thread is arranged at a junction of the connecting element 43 and the junction is configured to connect to the atomization core 3, and an external thread matching the internal thread is arranged at an outer surface of the atomization core 3. If other detachable connection structure is employed between the connecting element 43 and the atomization core 3, other connection structure can be arranged on the connecting element 43, for example, a flexible buckle shell fragment in a buckle connection etc. In the embodiment, the threaded connection is only described as an example and it is not limited to the threaded connection.

Figure 4:
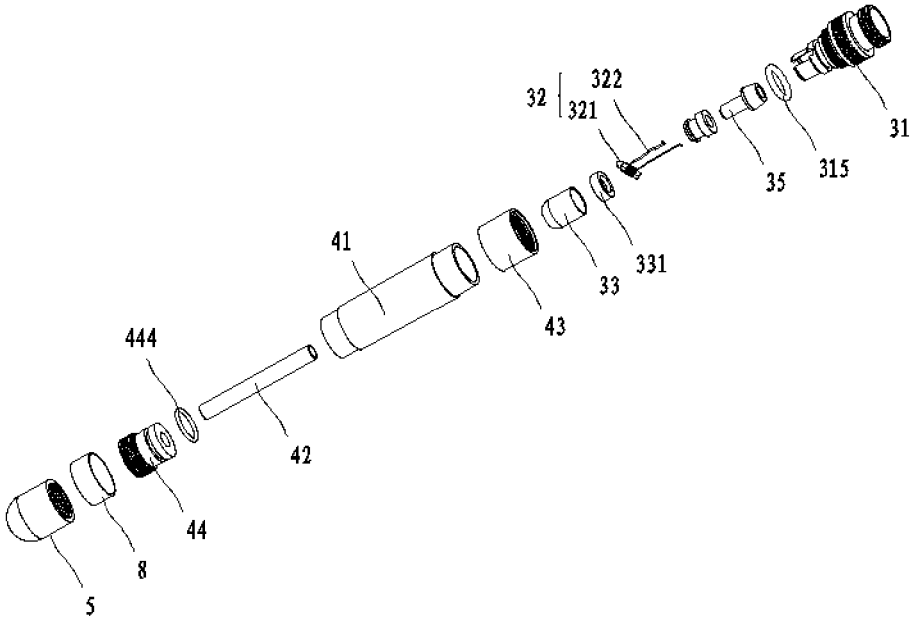
FIG. 4 is an exploded view of the atomization assembly of FIG. 3.
Figure 5:
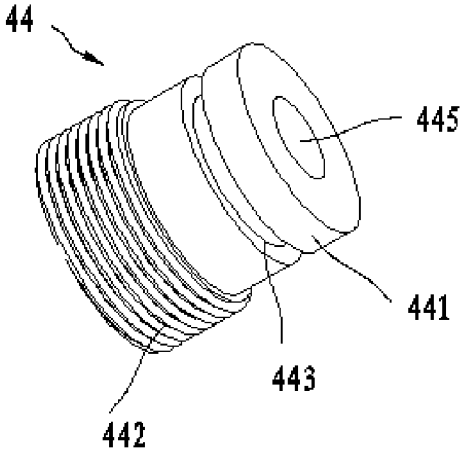
FIG. 5 is a structure schematic view of the connection column of the atomization assembly of FIG. 4.
Figure 6:
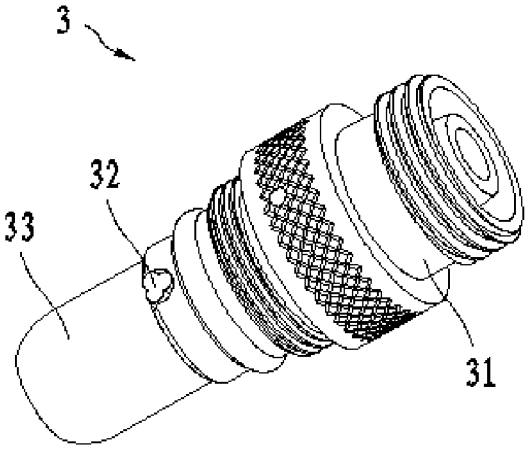
FIG. 6 is a structure schematic view of the atomization core of the atomization assembly of FIG. 1.

As shown in FIG. 5, the structure of the connection column 44 is approximately a column. The connection column 44 comprises a first connection portion 441 configured to be inserted into the atomization sleeve 41, and a second connection portion 442 configured to detachably connect to the suction nozzle cover 5. In the embodiment, in order to prevent the smoke tar in the first oil storage container 45 from leaking from the connection column 44, a first sealing element 444 (as shown in FIG. 4) is sleeved on the first connection portion 441. Specifically, an annular slot 443 is defined on an outer circumferential wall of the first connection portion 441, and the first sealing element 444 is fixed in the annular slot 443, and the first sealing element 444 is abutted against an inner circumferential wall of the atomization sleeve 41 to seal the smoke tar.

Further, a fixing recess 445 is axially arranged at one end of the connection column 44 and the end is away from the suction nozzle cover 5. One end of the vent-pipe 42 is abutted against and fixed in the fixing recess 445. An air groove 446 (as shown in FIG. 3) communicating with the fixing recess 445 is arranged at the other end of the connection column 44 and the other end is close to the suction nozzle cover 5. After successively passing through the vent-pipe 42, the air groove 446 and the second oil storage container 52, the smoke is discharged out of the outlet 51 and is provided to the user.

Further, in order to improve the reliability of the connection and to enhance the appearance of the electronic cigarette, a fastening ring 8 made of metal is arranged at a junction between the suction nozzle cover 5 and the connection column 44. As shown in FIG. 4, promotional text or picture such as logo can be written on the fastening ring 8. The fastening ring 8 is sleeve on the atomization sleeve 41.

The specific structure of the atomization core 3 will be described in detail with the embodiments shown in FIGS. 3, 4, 6 and 7.

The two ends of the atomization core 3 are detachably connected to the atomization sleeve 41 and the battery assembly respectively. The detachable connection structure can be a threaded connection structure or a buckle connection structure. In the embodiment, both the connection between the atomization core 3 and the atomization sleeve 41 and the connection between the atomization core 3 and the battery assembly are threaded connections.

As shown in FIG. 3, the atomization core 3 mainly comprises a connection sleeve 31, a heating wire assembly 32, an atomization cover 33, an atomization chamber 34 and an electrical connecting element 35. Wherein the atomization chamber 34 is defined in the connection sleeve 31, axially passes through the connection sleeve 31, and communicates with the vent-pipe 42. The heating wire assembly 32 is received in the atomization chamber 34. The atomization cover 33 is configured to sheathe the connection sleeve 31 and the vent-pipe 42, and is abutted against the heating wire assembly 32. One end of the vent-pipe 42 passes through the atomization cover 33 and extends to the inside of the atomization chamber 34.

Specifically, the connection sleeve 31 is detachably connected to the connecting element 43 which is connected to one end of the atomization sleeve 41. In the embodiment, the connection between the connection sleeve 31 and the connecting element 43 is a threaded connection.

Figure 7:
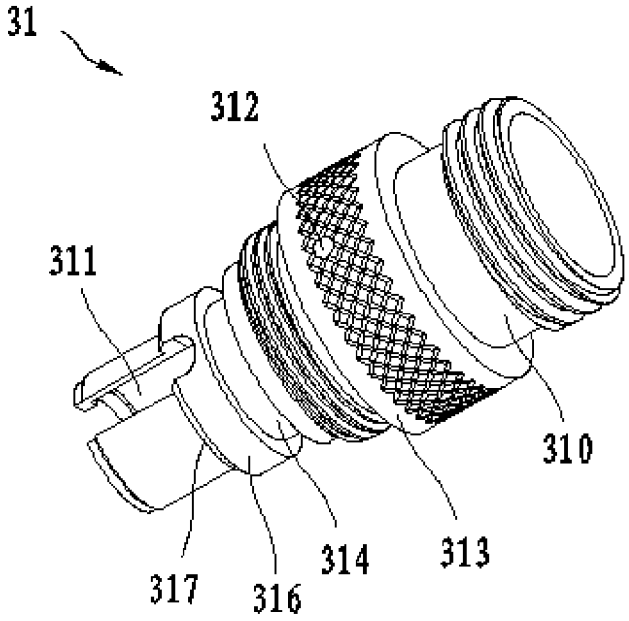
FIG. 7 is a structure schematic view of the connection sleeve of the atomization core of FIG. 6.

As shown in FIG. 7, the connection sleeve 31 comprises a body 310 with an approximate hollow cylindrical structure. A mounting notch 311, a through-hole 312, a limit clamping table 313, an annular groove 314, a protrusion 316, a limit protruding part 317 and an annular clamping table 318 (as shown in FIG. 3) are arranged on the body 310.

The mounting notch 311 is defined at one end of the body 310, close to the suction nozzle cover 5, and the mounting notch 311 extends away from the suction nozzle cover 5. In the embodiment, there are two mounting notches 311. The two mounting notches 311 communicated with the first oil storage container 45 are arranged opposite to each other with intervals. The heating wire assembly 32 is mounted and fixed at the bottom of the mounting notch 311.

The through-hole 312 is defined on one end of the body 310 wherein the end extends out of the atomization sleeve 41, and the through-hole 312 communicates with the atomization chamber 34. The through-hole 312 is mainly used for air inflow and discharging the smoke tar in the atomization chamber 34. Since the through-hole 312 is located at the outside of the atomization sleeve 41, the airflow can directly pass through the through-hole 312 and enter the atomization chamber 34 without making noise.

Further, when assembling the atomization core 3, in order to avoid the connecting element 43 blocking the through-hole 312, the limit clamping table 313 can be arranged on an outer circumferential wall of the body 310. The limit clamping table 313 is abutted against the side border of one end of the connecting element 43. The through-hole 312 is defined on the limit clamping table 313, thus avoiding blocking the through-hole 312 during the assembly.

Further, in order to make it convenient for the user to disassemble the atomization core 3, a knurled part (not numbered in the figure) can be defined on the limit clamping table 313.

Further, in order to avoid the smoke tar leaking from a junction between the body 310 and the atomization sleeve 41, a second sealing element 315 is sleeved on the body 310. Specifically, in the embodiment, the annular slot 314 is defined on the outer circumferential wall of the body 310 located in the atomization sleeve 41. The second sealing element 315 is fixed in the annular slot 314 and is flexibly abutted against an inner wall of the atomization sleeve 41 to achieve the sealing action.

Further, in order to better support the heating wire assembly 32, the protrusion 316 configured to support the heating wire assembly 32 is defined on the body 310. One end of the protrusion 316 is fixed on the bottom of the mounting notch 311, and the other end axially extends away from the body 310. By defining the protrusion 316, it can avoid the heating wire assembly 32 falling into the atomization chamber 34 due to the side wall for supporting the heating wire assembly 32 being too thin.

Further, since the atomization cover 33 is configured to sheathe the connection sleeve 31 and the vent-pipe 42, and is abutted against the heating wire assembly 32, in order to avoid the atomization cover 33 excessively compressing the heating wire assembly 32, the limit protruding part 317 abutted against the end surface of the atomization cover 33 can be arranged on the body 310.

As shown in FIG. 4, the heating wire assembly 32 comprises an oil guiding element 321 and a heating wire 322. The oil guiding element 321 is made of oil absorbing materials, and is fixed at the bottom of the mounting notch 311. The two ends of the oil guiding element 321 extend to the inside of the first oil storage container 45 respectively. The heating wire 322 is twined around the oil guiding element 321, and is electrically connected to the battery assembly. Since the heating wire assembly 32 is a conventional means of the prior art, the specific structures are not discussed here.

As shown in FIGS. 4 and 3, a containing cavity (not numbered in the figures) is axially defined in the atomization cover 33 and passes through the atomization cover 33. One end of the atomization cover 33, away from the suction nozzle cover 5, sheathes on the body 310 and is abutted against the limit protruding part 317. The vent-pipe 42 is plugged from the other end of the atomization cover 33, close to the suction nozzle cover 5. The vent-pipe 42 is coupled to the side wall of the containing cavity with an interference fit.

Further, in order to prevent the smoke tar from leaking from a junction between the vent-pipe 42 and the atomization cover 33, a third sealing element 331 can be arranged on a side wall of the containing cavity in the atomization cover 33. One end of the third sealing element 331 is fixed on the side wall of the containing cavity and the other end is flexibly abutted against an outer circumferential wall of the vent-pipe 42 to achieve a sealing action.

As shown in FIGS. 4 and 3, an electrical connecting element 35 configured to electrically connect to the battery assembly and the heating wire assembly 32 respectively is fixed in the atomization chamber 34. In the embodiment, the electrical connecting element 35 is fixed on the annular clamping table 318.

The annular clamping table 318 is defined on one end of the connection sleeve 31 and the end is configured to connect to the battery assembly. One end of the annular clamping table 318 is fixed on a side wall of the atomization chamber 34 and the other end extends toward the connection sleeve 31 along the axis to form a center hole (not numbered in the figures), and the electrical connecting element 35 is fixed at the center hole.

In the embodiment, the connection sleeve 31 is an external electrode electrically connected to the battery assembly. The electrical connecting element 35 comprises an insulator and an internal electrode (not numbered in the figure) electrically connected to the battery assembly, which are successively embedded in the center hole from outside in.

It should be understood that, in other embodiments, the electrical connecting element 35 can be other conductive structures, for example, the connection sleeve 31 is made of non-conductive material, the electrical connecting element 35 comprises an external electrode electrically connected to the battery assembly, an insulator and an inner electrode electrically connected to the battery assembly, which are successively embedded in the center hole from outside in.

In the embodiment, the atomization core 3 mainly comprises the connection sleeve 31. The atomization chamber 34 axially passes through the connection sleeve 31 and communicates with the vent-pipe 42. The heating wire assembly 32 is received in the atomization chamber 34. The atomization cover 33 is configured to sheathe the connection sleeve 31 and the vent-pipe 42, and is abutted against the heating wire assembly 32. One end of the vent-pipe 42 passes through the atomization cover 33 and extends inside the atomization chamber 34.

Figure 8:
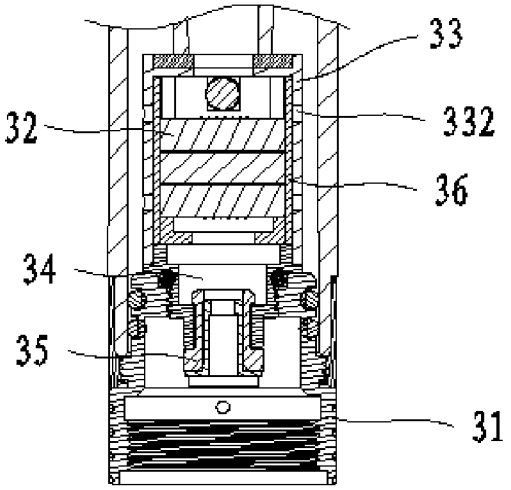
FIG. 8 is a structure schematic view of another atomization core of the atomization assembly of FIG. 1 when the atomization core coordinating with a vent-pipe and the atomization sleeve.

It should be understood that, the structure of the atomization core 3 of the present invention is not limited to the above structures and it can be other structures. For example, as shown in FIG. 8, the connection sleeve 31 of the atomization core 3 is made of non-conductive material. The electrical connecting element 35 comprises an external electrode electrically connected to the battery assembly, an insulator and an internal electrode electrically connected to the battery assembly, which are successively embedded in the center hole from outside in. Further, there are pluralities of heating wire assemblies 32, which are fixed at the atomization chamber 34 with spacing. Specifically, a plurality of mounting holes (not numbered in the figure) are defined on one end of the connection sleeve 31 and the end is close to the suction nozzle cover 5, and each heating wire assembly 32 is received in the mounting hole respectively. Several oil inlet holes 332 communicating with the oil storage container are defined on the circumferential wall of the atomization cover 33 of the atomization core 3. An oil storage cotton 36 is sheathed in the atomization cover 33, and the oil storage cotton 36 is used to absorb the smoke tar from the oil inlet hole 332 and provide oil for the heating wire assembly 32 to better avoid the smoke tar leaking.

Figure 9:
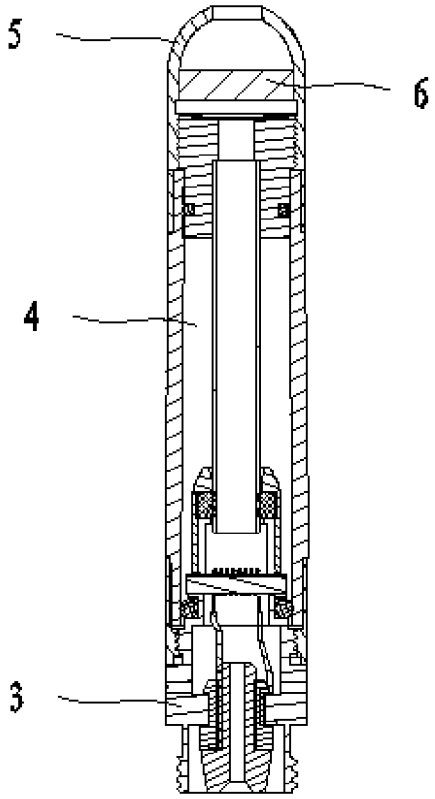
FIG. 9 is a structure schematic view of the atomization assembly, according to a second preferred embodiment of the present invention.

FIG. 9 shows the atomization assembly, according to a second preferred embodiment of the present invention. The difference between the first embodiment and the second embodiment is that an oil absorbing element 6 is received in the second oil storage container 52, and the oil absorbing element 6 is made of oil absorbing material.

Figure 10:
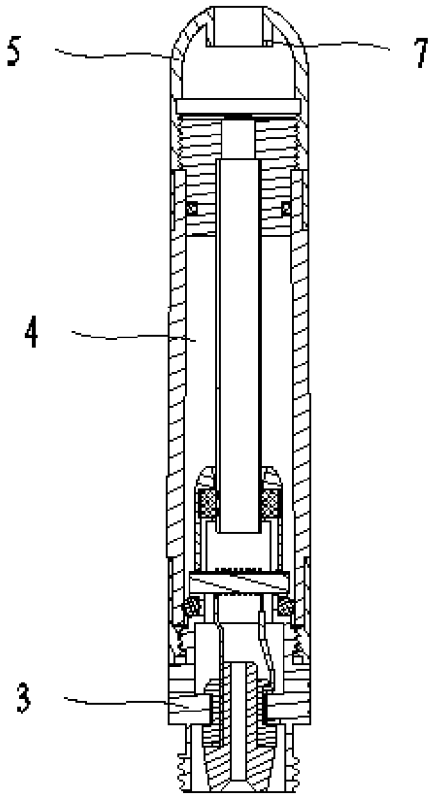
FIG. 10 is a structure schematic view of the atomization assembly, according to a third preferred embodiment of the present invention.

FIG. 10 shows the atomization assembly, according to a third preferred embodiment of the present invention. The difference between the first embodiment and the third embodiment is that an annular protruding platform 7 configured to block the smoke tar is arranged on the side wall of the second oil storage container 52 and the annular protruding platform 7 is located around a circumferential of the outlet 51 and extends toward the atomization sleeve 41.

Figure 11:
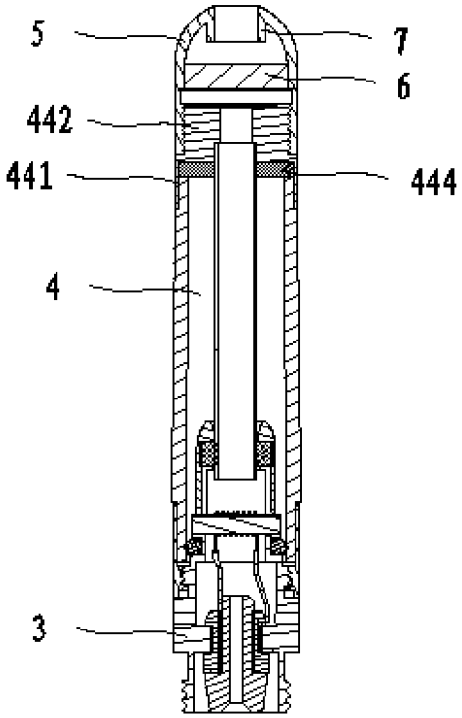
FIG. 11 is a structure schematic view of the atomization assembly, according to a fourth preferred embodiment of the present invention.

FIG. 11 shows the atomization assembly, according to a fourth preferred embodiment of the present invention. The difference between the first embodiment and the fourth embodiment is the specific structure of the connection column 44.

As shown in FIG. 11, the connection column 44 comprises a first connection portion 441 configured to plug with the atomization sleeve 41, and a second connection portion 442 configured to detachably connect to the suction nozzle cover 5. The first connection portion 441 sheathes the atomization sleeve 41, but the first connection portion 441 in the first embodiment is plugged in the atomization sleeve 41. In the embodiment, the first connection portion 441 has a containing cavity (not numbered in the figure) connected to the atomization sleeve 41. The first sealing element 444 is received at the bottom wall of the containing cavity and is abutted against an end of the atomization sleeve 41 to achieve the sealing action.

The present invention further provides an electronic cigarette. The electronic cigarette comprises a battery assembly and an atomization assembly connected to the battery assembly, wherein the battery assembly is not described here for being prior art. The atomization assembly comprises a transparent atomization sleeve 41. One end of the atomization sleeve 41 is connected to a connection column 44, and the other end of the atomization sleeve 41 is detachably connected to an atomization core 3 configured to atomize the smoke tar. A vent-pipe 42 with two ends being inserted into the connection column 44 and the atomization core 3 respectively is sheathed in the atomization sleeve 41, and a first oil storage container 45 configured to store the smoke tar which will be atomized by the atomization core 3 is formed between the atomization sleeve 41 and the vent-pipe 42.

One end of the atomization core 3 is flexibly and hermetically connected to the vent-pipe 42, and the other end of the atomization core 3, detachably connected to the battery assembly, extends outside the atomization sleeve 41. One end of the connection column 44, extending outside the atomization sleeve 41, is detachably connected to the suction nozzle cover 5, and a second oil storage container 52 communicating with the vent-pipe 42 is defined in the suction nozzle cover 5. An outlet 51 configured to discharge the airflow is defined in the side wall of the second oil storage container 52, so that when the smoke atomized by the atomization core 3 flows to the outlet 51 through the vent-pipe 42, condensed smoke tar is able to be stored in the second oil storage container 52. The specific structure of the atomization assembly of the electronic cigarette refers to the specific structure atomization assembly above. Since the structure of the atomization assembly of the electronic cigarette is the same as the structure of the above atomization assembly, it can achieve the same effect.

In summary, when implementing the atomization assembly and the electronic cigarette of the present invention, the following advantageous effects can be achieved:

(1) By defining the second oil storage container in the suction nozzle cover, when smoking, the liquid smoke condensed on the vent-pipe flows into the second oil storage container in the suction nozzle cover along the airflow and is stored therein, and since the suction nozzle cover is detachably connected to the connection column, the user can disassemble the suction nozzle cover at regular time to clean the liquid smoke stored in the second oil storage container and to prevent the user from sucking in the liquid smoke.

(2) Comparing with the prior suction nozzle cover directly and tightly connected to the atomization sleeve, the threaded connection structure or the buckle connection structure between the suction nozzle cover and the connection column makes it easier to disassemble the suction nozzle cover, and avoids the problem of easily to fall off.

(3) Since the suction nozzle cover and the connection column are made of metal, when hard objects such as the tooth in the mouth are gripped on the connection column, it can avoid the suction nozzle cover easily falling off because of the elastic deformation.

(4) The atomization sleeve is made of transparent material, and it makes the user easy to view the residual smoke tar in the first oil storage container.

(5) A limit protruding part against the end surface of the atomization cover is defined at the outer surface of the connection sleeve, so that it avoids the atomization cover excessively compressing the heating wire assembly.

(6) The protruding part configured to support the heating wire assembly is arranged on the outer surface of the connection sleeve, so that it avoids the heating wire assembly sliding into the atomization chamber due to the side wall for supporting the heating wire assembly being too thin.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those with ordinary skills in the art can also make many modifications without breaking away from the subject of the present invention and the protection scope of the claims. All these modifications belong to the protection of the present invention.

What is claimed is:

1. An atomization assembly, configured to combine with a battery assembly to form an electronic cigarette, the atomization assembly comprising a transparent atomization sleeve, one end of the atomization sleeve is connected to a connection column, and the other end of the atomization sleeve is detachably connected to an atomization core configured to atomize smoke tar; a vent-pipe with two ends being inserted into the connection column and the atomization core respectively is sheathed in the atomization sleeve, and a first oil storage container configured to store the smoke tar which will be atomized by the atomization core is formed between the atomization sleeve and the vent-pipe;

wherein one end of the atomization core is flexibly and hermetically connected to the vent-pipe, and the other end of the atomization core, detachably connected to the battery assembly, extends outside the atomizer sleeve; one end of the connection column, extending outside the atomization sleeve, is detachably connected to a suction nozzle cover, and a second oil storage container connected to the vent-pipe is sheathed in the suction nozzle cover; an outlet configured to discharge airflow is defined in a side wall of the second oil storage container, so that when smoke atomized by the atomization core flows to the outlet through the vent-pipe, condensed smoke tar is able to be stored in the second oil storage container; and wherein an oil absorbing element is received in the second oil storage container.

2. The atomization assembly according to claim 1, wherein both the suction nozzle cover and the connection column are made of metal.

3. The atomization assembly according to claim 1, wherein a threaded connection structure or a buckle connection structure is arranged at a junction between the suction nozzle cover and the connection column.

4. The atomization assembly according to claim 1, wherein an atomization chamber communicating with the vent-pipe and a heating wire assembly received in the atomization chamber are arranged in the atomization core, and a through-hole configured for air inflow and discharging smoke tar in the atomization chamber is defined at one end of the atomization core and the end extends outside the atomization sleeve, and the through-hole communicates with the atomization chamber.

5. The atomization assembly according to claim 4, wherein the atomization core comprises a connection sleeve detachably connected to the atomization sleeve, the heating wire assembly and an atomization cover, the atomization chamber is defined in the connection sleeve and axially passes through the connection sleeve, and the through-hole communicating with the atomization chamber is defined on a circumferential wall of the connection sleeve;

wherein one end of the connection sleeve is detachably connected to the battery assembly, and two mounting notches corresponding to each other are defined at the other end of the connection sleeve; the two mounting notches are communicated with the first oil storage container and extend away from the suction nozzle cover, and the heating wire assembly is mounted in the two mounting notches; and wherein the atomization cover is configured to sheathe the connection sleeve and the vent-pipe, and is abutted against the heating wire assembly; and one end of the vent-pipe passes through the atomization cover and extends inside the atomization chamber.

6. The atomization assembly according to claim 5, wherein a limit protruding part abutted against an end surface of the atomization cover is arranged at an outer surface of the connection sleeve.

7. The atomization assembly according to claim 5, wherein a protruding part configured to support the heating wire assembly is arranged on an outer surface of the connection sleeve.

8. The atomization assembly according to claim 1, wherein an annular protruding platform configured to block the smoke tar is arranged on a side wall of the second oil storage container, the annular protruding platform is located around a circumferential of the outlet and extends toward the atomization sleeve.

9. The atomization assembly according to claim 1, wherein the connection column comprises a first connection portion configured to plug with the atomization sleeve, and a second connection portion configured to detachably connect to the suction nozzle cover; and wherein an annular slot is defined on an outer circumferential wall of the first connection portion, and a first sealing element flexibly abutted against an inner wall of the atomization sleeve is fixed in the annular slot.

10. The atomization assembly according to claim 9, wherein a fixing recess is axially arranged at one end of the connection column and the end is away from the suction nozzle cover, and one end of the vent-pipe is abutted against and fixed in the fixing recess; an air groove communicating with the fixing recess is arranged at the other end of the connection column and the other end is close to the suction nozzle cover.

11. The atomization assembly according to claim 1, wherein a connecting element detachably connected to the atomization core is connected to one end of the atomization sleeve via a plug connection and the end is away from the suction nozzle cover, and a threaded connection structure or a buckle connection structure is defined at a junction between the connecting element and the atomization core.

12. The atomization assembly according to claim 1, wherein a second sealing element flexibly abutted against an inner wall of the atomization sleeve is arranged at an outer circumferential wall of the atomization core located in the atomization sleeve.

13. The atomization assembly according to claim 1, wherein a third sealing element is arranged at a junction of the atomization core and the junction is configured for flexibly and hermetically connecting to the vent-pipe.

14. The electronic cigarette according to claim 1, wherein an outer end surface of the suction nozzle cover is spherical.

15. An electronic cigarette, comprising an atomization assembly and a battery assembly connected to the atomization assembly, wherein the atomization assembly comprises a transparent atomization sleeve, one end of the atomization sleeve is connected to a connection column, and the other end of the atomization sleeve is detachably connected to an atomization core configured to atomize smoke tar; a vent-pipe with two ends being inserted into the connection column and the atomization core respectively is sheathed in the atomization sleeve, and a first oil storage container configured to store the smoke tar which will be atomized by the atomization core is formed between the atomization sleeve and the vent-pipe; and wherein one end of the atomization core is flexibly and hermetically connected to the vent-pipe, and the other end of the atomization core, detachably connected to the battery assembly, extends outside the atomization sleeve; one end of the connection column, extending outside the atomization sleeve, is detachably connected to a suction nozzle cover, and a second oil storage container connected to the vent-pipe is defined in the suction nozzle cover; an outlet configured to discharge airflow is defined in a side wall of the second oil storage container, so that when smoke atomized by the atomization core flows to the outlet through the vent-pipe, condensed smoke tar is able to be stored in the second oil storage container; and wherein an oil absorbing element is received in the second oil storage container.

* * * * *